US009852586B2

(12) United States Patent
Moshal

(10) Patent No.: US 9,852,586 B2
(45) Date of Patent: Dec. 26, 2017

(54) SYSTEM FOR PLAYING MULTIPLAYER GAMES

(75) Inventor: Martin Paul Moshal, Gibraltar (GI)

(73) Assignee: Cork Group Trading Ltd., Tortola (VG)

( * ) Notice: Subject to any disclaimer, the term of this patent is extended or adjusted under 35 U.S.C. 154(b) by 545 days.

(21) Appl. No.: 13/228,964

(22) Filed: Sep. 9, 2011

(65) Prior Publication Data

US 2012/0289341 A1 Nov. 15, 2012

(30) Foreign Application Priority Data

May 13, 2011 (GB) ..... 1108118.9

(51) Int. Cl.
*G07F 17/32* (2006.01)

(52) U.S. Cl.
CPC ..... *G07F 17/3276* (2013.01); *G07F 17/3293* (2013.01)

(58) Field of Classification Search
CPC ..... A63F 13/00; A63F 2001/00; A63F 1/00; A63F 3/00157; A63F 13/12; A63F 13/30; A63F 13/31; A63F 13/32; A63F 13/323; A63F 13/327; A63F 13/33; A63F 13/332; A63F 13/335; A63F 13/34; A63F 13/35; A63F 13/352; A63F 13/355; G07F 17/3276; G07F 17/3293
USPC ..... 463/42
See application file for complete search history.

(56) References Cited

U.S. PATENT DOCUMENTS

| | | | |
|---|---|---|---|
| 3,810,627 | A | 5/1974 | Levy |
| 4,335,809 | A | 6/1982 | Wain |
| 4,614,342 | A | 9/1986 | Takashima |
| 4,636,951 | A | 1/1987 | Harlick |
| 4,760,527 | A | 7/1988 | Sidley |
| 4,926,327 | A | 5/1990 | Sidley |

(Continued)

FOREIGN PATENT DOCUMENTS

| | | |
|---|---|---|
| EP | 1 739 639 | 1/2007 |
| EP | 1 895 484 | 3/2008 |

(Continued)

OTHER PUBLICATIONS

European Search Report and European Search Opinion for EP 12 16 7537 dated May 14, 2013, 8 pages.

*Primary Examiner* — Kang Hu
*Assistant Examiner* — Jeffrey Wong
(74) *Attorney, Agent, or Firm* — McDonnell Boehnen; Hulbert & Berghoff LLP

(57) ABSTRACT

A computer system for playing multiplayer games comprises a first gaming server which runs multiple instances of a first game and to which is connected a first plurality of players, there being a minimum number of players and a maximum number of players for any instance of the first game; and a second gaming server which runs multiple instances of a second game and to which is connected a second plurality of players, there being a minimum number of players and a maximum number of players for any instance of the second game. The first gaming server is in communication with the second gaming server and through the second gaming server makes available instances of the first game for players from said second plurality of players to join. Thus, separate gaming servers can pool instances of games and players.

39 Claims, 7 Drawing Sheets

(56) References Cited

U.S. PATENT DOCUMENTS

| | | | | |
|---|---|---|---|---|
| 5,038,022 | A | 8/1991 | Lucero | |
| 5,083,271 | A | 1/1992 | Thacher et al. | |
| 5,096,195 | A | 3/1992 | Gimmon | |
| 5,159,549 | A | 10/1992 | Hallman, Jr. et al. | |
| 5,457,305 | A | 10/1995 | Akel et al. | |
| 5,476,259 | A | 12/1995 | Weingardt | |
| 5,505,449 | A | 4/1996 | Eberhardt et al. | |
| 5,559,312 | A | 9/1996 | Lucero | |
| 5,586,257 | A | 12/1996 | Perlman | |
| 5,613,912 | A | 3/1997 | Slater | |
| 5,655,961 | A | 8/1997 | Acres et al. | |
| 5,674,128 | A | 10/1997 | Holch et al. | |
| 5,735,525 | A | 4/1998 | McCrea, Jr. | |
| 5,761,647 | A | 6/1998 | Boushy | |
| 5,762,552 | A | 6/1998 | Vuong et al. | |
| 5,768,382 | A | 6/1998 | Schneier et al. | |
| 5,770,533 | A | 6/1998 | Franchi | |
| RE35,864 | E | 7/1998 | Weingardt | |
| 5,779,549 | A | 7/1998 | Walker et al. | |
| 5,800,268 | A | 9/1998 | Molnick | |
| 5,800,269 | A | 9/1998 | Holch et al. | |
| 5,809,482 | A | 9/1998 | Strisower | |
| 5,823,879 | A | 10/1998 | Goldberg et al. | |
| 5,833,540 | A | 11/1998 | Miodunski et al. | |
| 5,841,980 | A | 11/1998 | Waters et al. | |
| 5,851,149 | A | 12/1998 | Xidos et al. | |
| 5,857,911 | A | 1/1999 | Fioretti | |
| 5,970,143 | A | 10/1999 | Schneier et al. | |
| 5,974,566 | A | 10/1999 | Ault et al. | |
| 6,001,016 | A | 12/1999 | Walker et al. | |
| 6,012,984 | A | 1/2000 | Roseman | |
| 6,015,348 | A | 1/2000 | Lambright et al. | |
| 6,089,982 | A | 7/2000 | Holch et al. | |
| 6,117,011 | A | 9/2000 | Lvov | |
| 6,165,072 | A | 12/2000 | Davis et al. | |
| 6,183,362 | B1 | 2/2001 | Boushy | |
| 6,183,366 | B1 | 2/2001 | Goldberg et al. | |
| 6,196,920 | B1 | 3/2001 | Spaur et al. | |
| 6,224,486 | B1 * | 5/2001 | Walker et al. | 463/42 |
| 6,241,608 | B1 | 6/2001 | Torango | |
| 6,257,981 | B1 | 7/2001 | Acres et al. | |
| 6,264,560 | B1 | 7/2001 | Goldberg et al. | |
| 6,302,793 | B1 | 10/2001 | Fertitta, III et al. | |
| 6,352,479 | B1 | 3/2002 | Sparks, II | |
| 6,371,852 | B1 | 4/2002 | Acres | |
| 6,394,907 | B1 | 5/2002 | Rowe | |
| 6,435,968 | B1 | 8/2002 | Torango | |
| 6,532,448 | B1 | 3/2003 | Higginson et al. | |
| 6,626,757 | B2 | 9/2003 | Oliveras | |
| 6,656,040 | B1 | 12/2003 | Brosnan et al. | |
| 6,679,777 | B2 | 1/2004 | Pfeiffer et al. | |
| 6,692,353 | B2 | 2/2004 | Walker et al. | |
| 6,712,702 | B2 | 3/2004 | Goldberg et al. | |
| 6,767,284 | B1 | 7/2004 | Koza | |
| 6,837,789 | B2 | 1/2005 | Garahi et al. | |
| 6,866,586 | B2 | 3/2005 | Oberberger et al. | |
| 6,884,166 | B2 | 4/2005 | Leen et al. | |
| 6,887,151 | B2 | 5/2005 | Leen et al. | |
| 6,887,159 | B2 | 5/2005 | Leen et al. | |
| 6,893,347 | B1 | 5/2005 | Zilliacus et al. | |
| 6,899,628 | B2 | 5/2005 | Leen et al. | |
| 6,979,267 | B2 | 12/2005 | Leen et al. | |
| 7,113,975 | B2 | 9/2006 | Nakayama et al. | |
| 7,128,652 | B1 | 10/2006 | Lavoie et al. | |
| 7,186,181 | B2 | 3/2007 | Rowe | |
| 7,240,093 | B1 | 7/2007 | Danieli et al. | |
| 7,384,336 | B2 | 6/2008 | Torango | |
| 7,387,571 | B2 | 6/2008 | Walker et al. | |
| 7,419,428 | B2 | 9/2008 | Rowe | |
| 7,699,702 | B2 | 4/2010 | Daniel | |
| 7,722,466 | B2 | 5/2010 | Rothschild | |
| 8,047,913 | B2 | 11/2011 | Moshal | |
| 2001/0037253 | A1 | 11/2001 | Kensey | |
| 2002/0094869 | A1 | 7/2002 | Harkham | |
| 2002/0138594 | A1 | 9/2002 | Rowe | |
| 2002/0147047 | A1 | 10/2002 | Letovsky et al. | |
| 2003/0069071 | A1 | 4/2003 | Britt et al. | |
| 2004/0254010 | A1 | 12/2004 | Fine | |
| 2006/0084499 | A1 * | 4/2006 | Moshal | 463/25 |
| 2006/0211479 | A1 * | 9/2006 | Walker | G07F 17/32 463/16 |
| 2008/0032801 | A1 * | 2/2008 | Brunet de Courssou | G07F 17/32 463/42 |
| 2009/0264202 | A1 * | 10/2009 | Chen et al. | 463/42 |
| 2010/0228619 | A1 | 9/2010 | Goldberg et al. | |
| 2011/0034240 | A1 * | 2/2011 | Naicker et al. | 463/27 |
| 2013/0247039 | A1 * | 9/2013 | Tsutsui | 718/1 |

FOREIGN PATENT DOCUMENTS

| | | | |
|---|---|---|---|
| EP | 1 903 522 | | 3/2008 |
| EP | 1 912 185 | | 4/2008 |
| EP | 2 284 812 | | 2/2011 |
| GB | WO 03/093921 | A2 * | 11/2003 |
| WO | 01/50391 | A1 | 7/2001 |
| WO | 03/093921 | | 11/2003 |
| WO | 03/093921 | A2 | 11/2003 |
| WO | 2004/050201 | | 6/2004 |
| WO | 2005/033825 | | 4/2005 |

* cited by examiner

SYSTEM FOR PLAYING MULTIPLAYER GAMES

FIELD OF THE INVENTION

This invention relates to a system for playing multiplayer games and in particular, but not exclusively, multiplayer zero-sum wager games such as multiplayer poker.

BACKGROUND

The game of poker is a multiplayer game, generally accommodating, for example, a minimum of four and a maximum of between eight and ten players. During the game players make wagers which are accumulated in a single pool ("the pot"). Once the wagering stages of the game have been completed, the players who remain in the game reveal the playing cards in their hands. The hands are ranked, and the player with the highest-ranking hand wins the pot.

The game of poker is a zero-sum game insofar as, in each turn of the game, a gain of the winner is equal to accumulated losses of the other players in the game. However, a party who arranges or hosts a game of poker may levy a commission ("a rake") on the players or on the pot in order to obtain revenue. Further examples of such multiplayer zero-sum games are backgammon, bridge, gin rummy, canasta, whist or mah-jong.

A system and method for playing zero-sum games, such as poker, over a computer network is described in published PCT Application WO 03/093921 A2, published 13 Nov. 2003, which is assigned to the assignee of the present invention. The entire contents of WO 03/093921 A2 are incorporated by reference herein. The system of the '921 PCT publication includes a central gaming server accessible over the Internet and enables participation in games such as poker games by individuals accessing diverse portal websites (poker websites).

In the last several years, systems have been commercialised such as that described in the '921 patent publication wherein a gaming website provides a facility for online game playing, particularly online poker playing. Such systems have become popular and, gaming sites may host hundreds, even thousands of players at a time.

In online poker, the success of an online poker website ("virtual poker room") is directly related to the magnitude of a pool of would-be players who desire to play a game of online poker. Simply put, the larger the pool of players (i.e. the "liquidity"), the more poker games (i.e. virtual poker tables each accommodating a maximum of, say, eight players) the system can spawn, thereby increasing its attractiveness to other would-be players. In particular, a player may join in a virtual poker game at which an unoccupied playing position, or vacancy, exists. If a virtual poker game has no vacancies available, a would-be player may have to wait a considerable time before a vacant playing position becomes available, allowing the player to join the game, which may cause frustration and which may cause the would-be player to leave the gaming website. Conversely, a would-be player may also have to wait for a considerable period before a sufficient number of other would-be players become available to establish a poker game and to enable play to commence, which can also cause frustration and lead to player attrition. Increased liquidity is generally attractive to would-be players.

In order to maximise this size advantage, some online poker rooms operate under a centralised topology, in which there is a single operating entity ("operator") that owns and runs the gaming website and the player pool is homogeneous (i.e. all players are registered with, or "belong to", this single operator). The operator makes money by charging a rake on the accumulated pot in each game of poker that is played in the online poker room. Under a centralised topology, a player will always be playing only with other players who are registered with the same (i.e. the only) operator. Settlement of player wagers is straightforward: 1) the operator deducts its rake from the pot; 2) the balance of the pot is paid over to the player that has won the game; and 3) the next game starts and the process repeats.

Other online poker rooms may operate under a distributed topology (also referred to, in the art, as a network topology). Under this topology, the player pool is heterogeneous, as players registered with different, possibly competing, operators are pooled together to maximise liquidity of the collective player pool, as previously discussed. This means that players registered with different operators could find themselves playing in the same poker game. In this instance, settlement of player wagers is more complex than in the centralised topology, as situations invariably arise in which funds have to be transferred, (or "cleared") between different operators whose players are playing under a distributed topology. The principles underlying a distributed topology are set forth in the above-referenced patent application WO 03/093921 A2.

SUMMARY

In a first aspect, a system for playing a multiplayer zero-sum game is provided. The system comprises a plurality of gaming servers and a plurality of databases. Each gaming server is able to host separate instances of the multiplayer zero-sum game, and for each such instance of the multiplayer zero-sum game the host gaming server is configured to (i) generate random events that are displayable as outcomes on client computers used by players participating in the instance of the game, (ii) enable each participating player to place a wager for each turn of the game, and (iii) determine a winner for each turn of the game. Each database is configured to store game information data regarding active instances of the multiplayer zero-sum game hosted by a respective gaming server, and at least one of the databases is configured to store game information data regarding active instances of the multiplayer zero-sum game hosted by multiple gaming servers. Each gaming server is further configured to provide the game information data stored in its respective database to client computers of prospective players.

In a second aspect, a method is provided. In accordance with the method, a client computer receives from a local gaming server a list of active instances of a multiplayer zero-sum game, wherein the list includes active game instances hosted by the local gaming server and active instances hosted by a remote gaming server. The client computer displays the list to a player. The client computer receives from the player a selection of an active game instance on the list.

In a third aspect, a method for settlement of player wagers is provided. In accordance with the method, a host gaming server hosts a multiplayer zero-sum game involving a plurality of players associated with a plurality of gaming entities. The plurality of players includes one or more players using client computers that communicate natively with the host gaming server and one or more players using client computers that communicate with the host gaming server by means of an application programming interface (API), wherein each player is associated with a respective gaming entity with which the player has a credit account, and wherein each gaming entity has a respective clearing account. The host gaming server notifies an application server of an outcome of a turn of the game, including losses and winnings of the players participating in the turn, together with data representative of each gaming entity associated with each participating player. The application server debits the clearing account of each gaming entity associated with each player that has wagered on the turn of the game by the total amount wagered by that player. The application server credits the clearing account of each gaming entity associated with each winning player by the amount of the pot less a rake amount. The application server credits a portion of the rake amount to the clearing account of each gaming entity in proportion to the number of participating players associated with that gaming entity.

DETAILED DESCRIPTION

Figure 1:
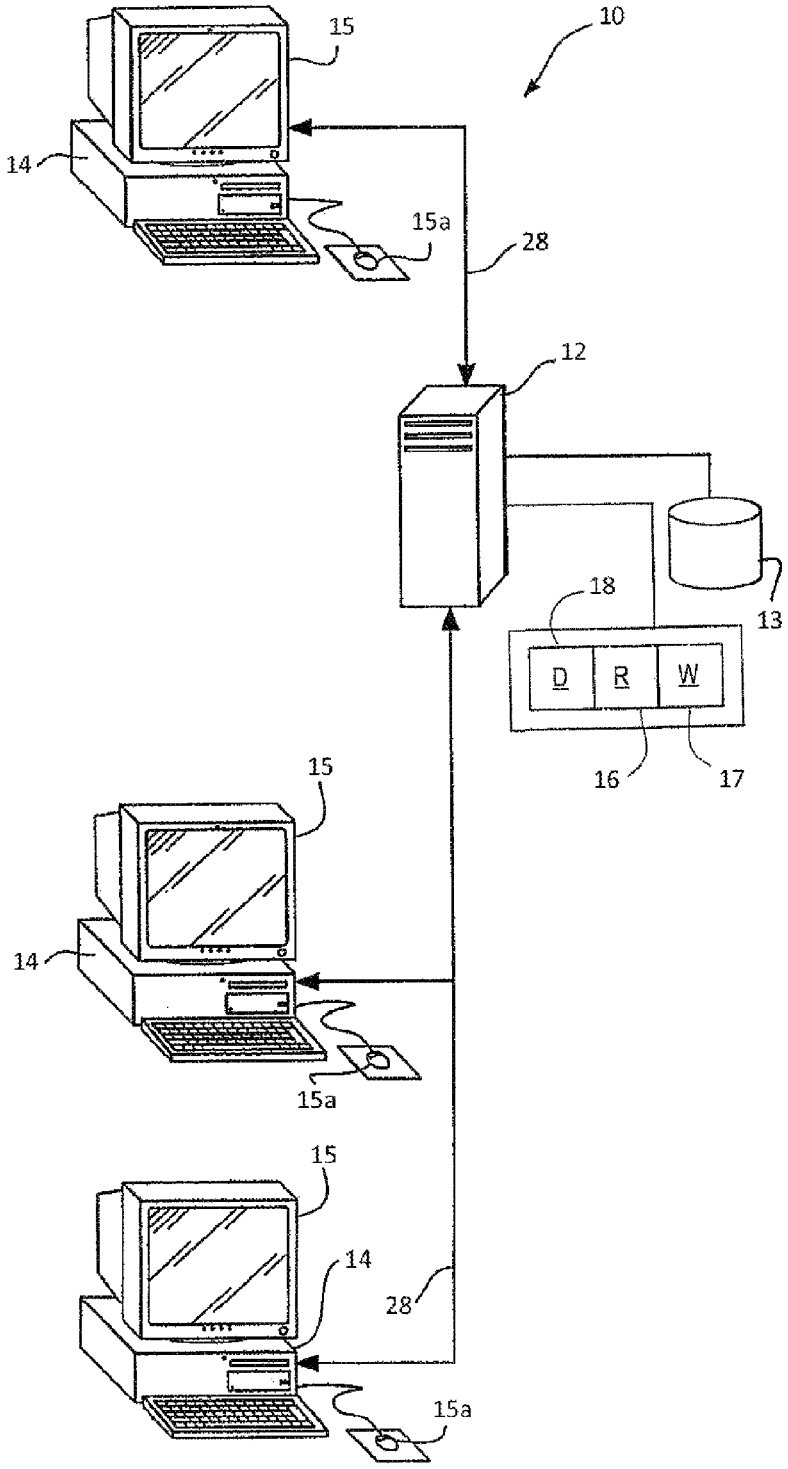
FIG. 1 is a schematic representation of a system for playing a virtual multiplayer zero-sum game.

The applicant has appreciated that enhancements are possible both to a conventional system and to the system of the '921 publication in order to further increase player liquidity and reduce player waiting time.

Viewed from one aspect the invention provides a computer system for playing multiplayer games, comprising a first gaming server which runs multiple instances of a first game and to which is connected a first plurality of players, there being a minimum number of players and a maximum number of players for any instance of the first game; and a second gaming server which runs multiple instances of a second game and to which is connected a second plurality of players, there being a minimum number of players and a maximum number of players for any instance of the second game; wherein the first gaming server is in communication with the second gaming server and through the second gaming server makes available instances of the first game for players from said second plurality of players to join, and an administration facility maintains a record of players in an instance of the first game, including information indicative of whether a player is from said first plurality of players or from said second of plurality of players.

Thus, if a player who is connected to the second gaming server is unable to join an instance of the second game because current instances of the second game have the maximum number of players, and there are insufficient players for a further instance of the second game to be spawned, that player has access to any instances of the first game on the first gaming server which do not yet have the maximum number of players, and can join with one or more other players on the first gaming server to make up the minimum number of players for a new instance of the first game.

Preferably, the second gaming server is also in communication with the first gaming server and through the first gaming server makes available instances of the second game for players from said first plurality of players to join, and an administration facility maintains a record of players in an instance of the second game, including information indicative of whether a player is from said first plurality of players or from said second of plurality of players. Thus irrespective of which server a player is connected to, that player will have access to instances of a game being run on the other server.

Preferably the first game and the second game are the same. The game may be, for example, poker.

It will be appreciated that there may be more than two servers, all pooling their available game instances for players to join irrespective of the server to which they are connected, and all pooling their respective pluralities of players for one of the gaming servers so as to make up the minimum number of players for a new instance of a game on that gaming server.

Whilst in the '921 publication players may be pooled from a number of portals to access a central gaming server, in the new architecture in accordance with the present invention, separate gaming servers pool instances of games and players.

Embodiments will be described with particular reference to a system for playing a game of multiplayer poker in virtual poker rooms. It is to be clearly understood, however, that the scope of the invention is not limited to this particular application.

1. Overview

It is desirable to increase the player liquidity of virtual poker rooms. It is also desirable to reduce the waiting time for players who wish to participate in game play or tournament play in a virtual poker room. Having made this insight, the present disclosure provides for new methods of aggregating players in virtual poker rooms that address these problems, surpassing the ability of the prior art to do so.

Before describing the preferred embodiment in detail, an explanation will first be provided of computer-based systems for online game playing in which multiple distributed computing devices engage in playing of card games using a central server and, in particular, wager games such as poker. The following descriptions are offered by way of illustration and not limitation, of possible environments in which the invention can be practised.

Referring to FIG. 1, a system for playing a virtual game of multiplayer poker is indicated generally by reference numeral 10. The system 10 has a centralised topology and includes a gaming server 12 accessible to would-be players (not shown) through respective user access facilities 14 in the form of networked computing devices such as computer workstations, each having a display 15 and an associated pointing device 15*a* such as a mouse or, alternatively, a touchpad.

The game of multiplayer poker using a computing device or computer workstation 14 is facilitated by means of a workstation-stored program (not shown) referred to, for convenience, as a client process that is executable on the computer workstation 14, and a server-stored program (not shown), or server process, that is executable on the gaming server 12. The server process (not shown) generates one or more random events that affect the outcome of the game of poker, such as the dealing of cards to participating players. The client process on a computer workstation 14 of a participating player obtains the result of the random events from the gaming server 12 and displays the outcome of the game on the display monitor 15 in an intelligible manner.

The gaming server 12 includes a processing unit (such as a central processing unit, not shown) and a database 13 coupled to the processing unit that stores game information data for a plurality of instances of games playable at the computer workstations 14. The server-stored program (not shown) enables a predetermined maximum number of players, say eight, to play an instance of the game of multiplayer poker. Each instance of the game may take the form of a virtual poker table playing a particular game (e.g., Hold'em) or a virtual poker table that forms part of a tournament, such as a virtual poker tournament. When the number of players for a given instance of the game reaches this predetermined maximum number, the server-stored program initiates a further instance of the game (i.e. a new virtual poker table), the new instance of the game also being capable of accommodating a further eight players. In this manner the gaming server 12 is capable, under control of the server-stored program, of spawning as many separate instances of the multiplayer poker game as required in order to accommodate a pool of players who desire to play the game. Each instance of the game spawned in this manner is treated as totally independent of the other instances. The database 13 is updated continuously to store real-time or near real-time information as to the plurality of active game instances hosted on the gaming server 12, such as the name of each instance (e.g., a table name), the identity of players at each table, the table stakes, available seats, etc. The gaming server 12 provides this game information data to the computer workstations 14 in the form of lobby pages.

The server-stored program also provides a wagering means 17 in the form of computer instructions that enable any participating player to place wagers on a turn of the game, as well as discrimination means in the form of computer instructions 18 capable of ranking poker hands and determining a winner or winners of the turn of the game. The stored program in the gaming server 12 maintains a dynamic register 16 of all players admitted to, and participating in, any of the spawned instances of the game from time to time. The gaming server 12 also settles the wagers of the participating players in each turn of the game by debiting wagered amounts from the player accounts of losing players and crediting the amount of the pot to the accounts of winning players.

The computer workstations 14 may, for example, take the form of conventional personal computers operating under a Windows, Linux or Macintosh operating system, provisioned with a web browser and a connection to the Internet. The computer workstations 14 may also, for example, take the form of portable, handheld computing devices with a web browser and wireless Internet access.

Figure 3:
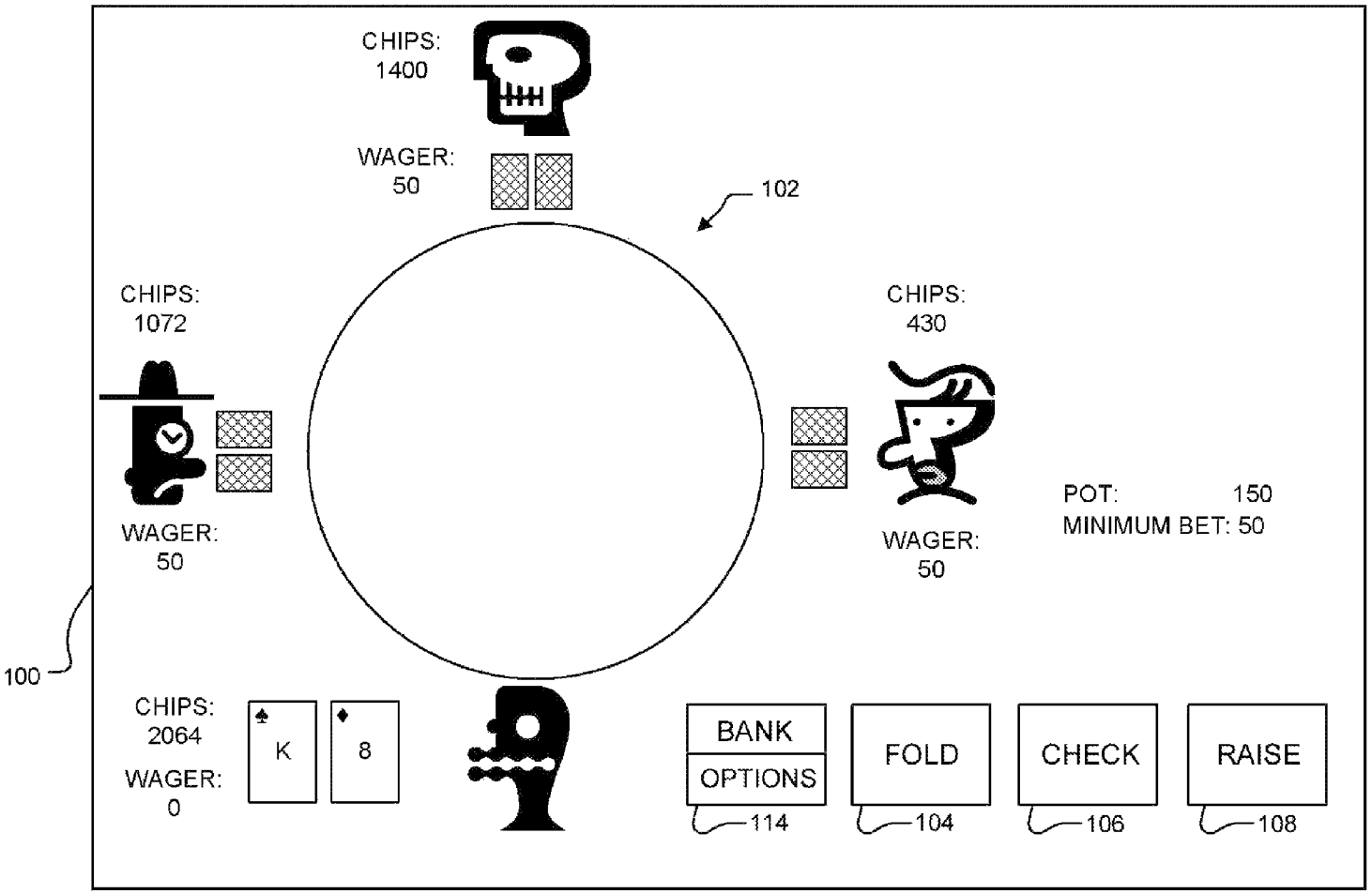
FIG. 3 is a graphical user interface associated with the system of FIG. 1 or FIG. 2.

After first registering with the gaming server 12 and establishing a player credit account, a player who desires to join the game of multiplayer poker may, by means of one of the computer workstations 14, log in to the gaming server 12 and request participation in the game. Once admitted to an instance of the game, the player may place a wager on a turn of that instance of the game. During play, each participating player is presented with an identical graphical user interface (GUI) 100 on the player's respective computer workstation 14 by the client process (not shown) in the workstation, as shown in FIG. 3. The GUI 100 presents to the player a suitable display of a poker game 102 with appropriate activatable icons 104, 106, 108 and 114 that enable the player to make his own desired game play decisions and to monitor the progress of the multiplayer game by viewing the game play decisions of the other participating players in the same instance of the game. The manner in which a participating player uses the GUI 100 to play the game of multiplayer poker is not important and will not be described here in detail.

Figure 2:
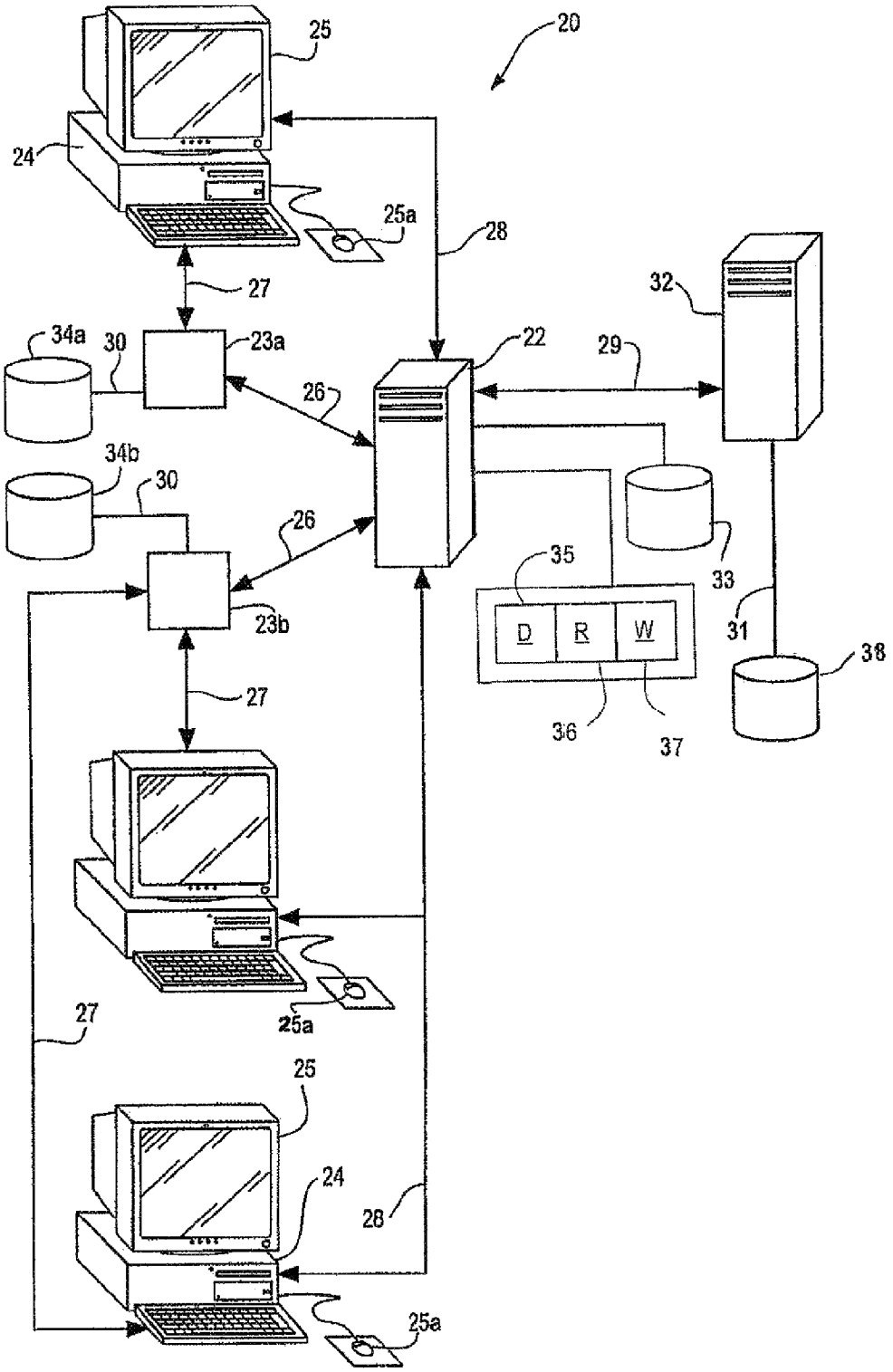
FIG. 2 is a schematic representation of an alternative system for playing a virtual multiplayer zero-sum game.

Referring now to FIG. 2, a further system for playing a virtual game of multiplayer poker is indicated generally by reference numeral 20. The system 20, which has a distributed topology, includes a central gaming server 22, and a number of portals 23*a*, 23*b* in the form of poker room websites. In the example shown, each one of the poker room websites 23*a*, 23*b* is accessible to would-be poker players (not shown) through respective user-access facilities 24 in the form of networked computing devices such as computer workstations, each having a display 25 and an associated pointing device 25*a*, for example a mouse or a touchpad. In this embodiment, poker room website 23*a* is shown as having one computing workstation 24 logically connected thereto, whereas poker room website 23*b* is shown as being logically connected to two computer workstations 24. It will be appreciated by those skilled in the art that such online poker room websites 23*a*, 23*b* can be logically connected to any desired number of such computer workstations 24 simultaneously, which number is physically limited primarily by considerations of processing power, website hardware, and network bandwidth.

The game of multiplayer poker is facilitated by means of an executable program (not shown) on each of the computer workstations 24 (a client process), and a server-stored program (not shown), or server process, that is executable on the gaming server 22. The server process (not shown) generates one or more random events that affect the outcome of the game of poker, such as dealing cards to participating players. The client process on a computer workstation 24 of a participating player obtains the result of random events from the gaming server 22 and displays the outcome of the game on the display monitor 25 in an intelligible manner.

The example gaming server 22 includes a processing unit (such as a central processing unit, not shown) and a database 33 coupled to the processing unit that stores game information data for a plurality of instances of games playable at the computer workstations 24. The server-stored program (not shown) is capable of enabling a predetermined maximum number of players, say eight, to play an instance of the game of multiplayer poker. When the number of players reaches this predetermined maximum number, the server-stored program initiates a further instance of the game, the new instance of the game also being capable of accommodating a further eight players. In this manner the gaming server 22 is capable, under control of the server-stored program, of spawning as many separate instances of the multiplayer poker game as required in order to accommodate a pool of players who desire to play the game. Each instance of the game spawned in this manner is independent of the other instances. The database 33 is updated continuously to store real-time or near real-time information as to the plurality of active game instances hosted on the gaming server 22, such as the name of each instance (e.g., a table name), the identity of players at each table, the table stakes, available seats, etc. The gaming server 22 provides the game information data to the computer workstations 24, in the form of lobby pages.

The server-stored program also provides a wagering means 37 in the form of computer instructions that enable any participating player to place wagers during a turn of the game, as well as discrimination means in the form of computer instructions 35 capable of ranking poker hands and determining a winner or winners of the turn of the game. The server-stored program also maintains a dynamic register 36 of all players admitted to, and actively participating in, any of the spawned instances of the game from time to time, together with data representative of a corresponding poker room 23*a*, 23*b* through which each player accessed the game.

In order to play multiplayer poker or other games from any computer workstation 24, the client process (not shown) may first be downloaded to that computer workstation, for example, from the gaming server 22 or from a separate download server (not shown) or from the website 23*a* or 23*b*. Such a download will typically occur when the computer workstation 24 first accesses the website 23*a* or 23*b*, when the user is presented with a message inviting the user to download the client process in order to play the game. The user selects a "Yes" icon and the download then proceeds, whereafter the client process presents the user with a GUI 100 on the computer workstation 24, and communication between the computer workstation 24 and the gaming server 22 then proceeds. As indicated in FIG. 3, the GUI 100 presents to the player a display of a poker game 102 with activatable icons 104, 106, 108 and 114 that enable the player to make game play decisions and to monitor the progress of the multiplayer poker game by observing the game play decisions of the other participants in the same instance of the game. In this distributed-topology system, a player wishing to participate in the multiplayer games, such as poker, uses a computer workstation 24 to access an online poker room 23*a*, 23*b* of the player's choice. But, regardless of the choice of website, the user is presented with the same underlying GUI 100. The GUI 100 will typically have different trademarks, colour schemes, or "look and feel" depending from which online poker room the player downloaded the client process.

The system 20 includes, further, an administration facility 32 in the form of an application server, which is communicable with the gaming server 22 by means of a communication network 29. Although the operation of the application server 32 will be outlined briefly, for further details, the reader is directed to the published '921 PCT publication cited above for further reference. The gaming server 22, the poker room web servers (not shown) corresponding to the online poker room websites 23*a*, 23*b*, the computer workstations 24 and the application server 32 communicate with each other via the Internet, represented in FIG. 2 as separate logical communication channels 26-31.

The application server 32 provides a clearing account facility 38 with a clearing account for each of the online poker rooms 23*a*, 23*b*. Analogously, each online poker room website 23*a*, 23*b* includes a credit account for each player who participates in the game through that poker room website. In the system of FIG. 2, therefore, website 23*a* has one player credit account associated with it, while poker room website 23*b* has two associated player credit accounts.

Figure 4:
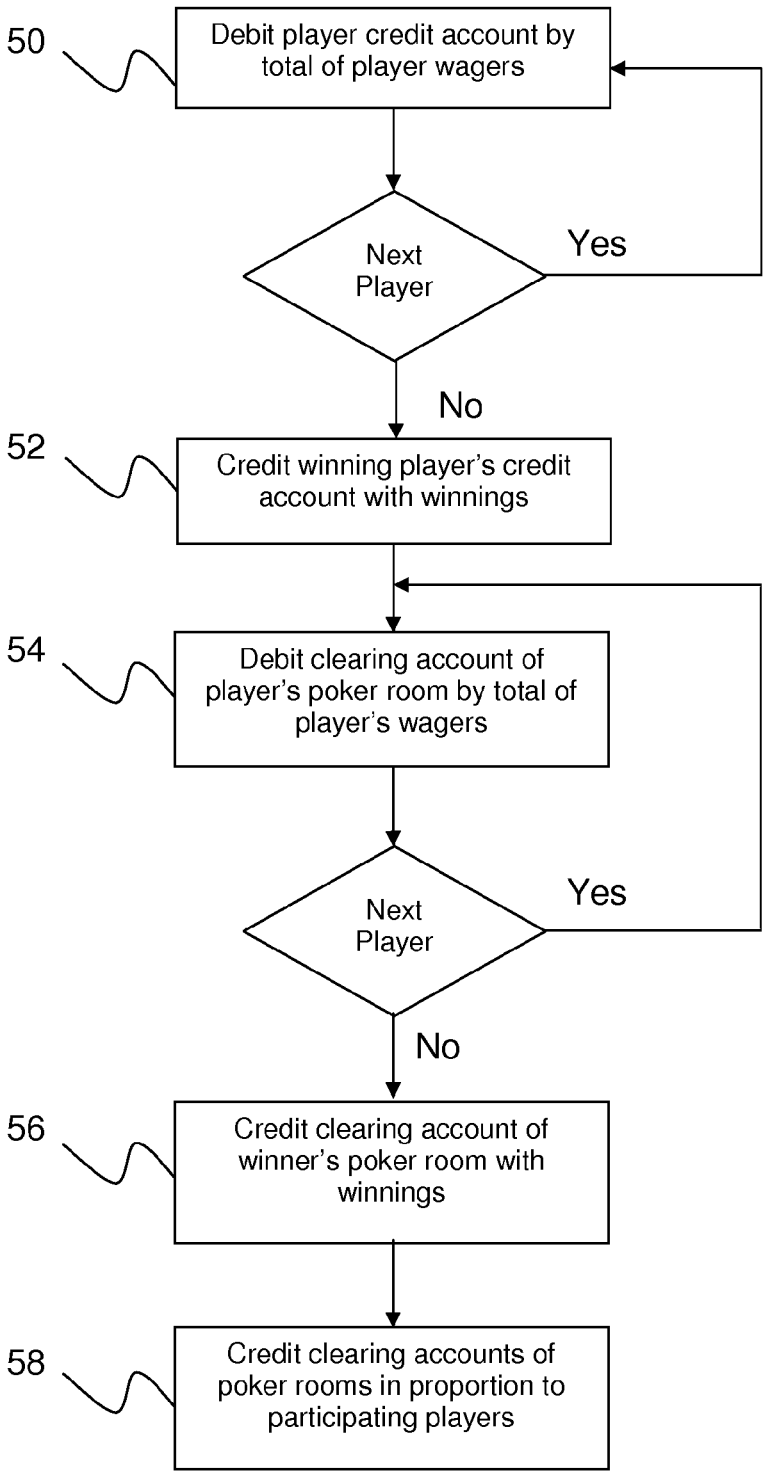
FIG. 4 is a flow diagram of the steps required in the settlement of player wagers in the system of FIG. 2.

Referring to FIG. 4, the example steps involved in settlement of player wagers are represented. During each turn of the game, the gaming server 22 debits, at step 50, the credit account of each participating player by the amounts wagered by that player. Once the turn of the game is complete, the discrimination means 35 determines the winner of the turn and the gaming server 22 credits, at step 52, the credit account of the winning player by the amount of the pot less an applicable rake amount. Furthermore:

1. the gaming server 22 notifies the application server 32 of the outcome of the turn of the game and of the losses and winnings of the players that participated in the turn, together with data representative of the poker room 23*a*, 23*b* through which each player accessed the game;
2. the application server 32 debits, at step 54, the clearing account of the poker room 23*a*, 23*b* associated with each player that has wagered on the turn of the game by the total amount wagered by that player;
3. the application server 32 credits, at step 56, the clearing account of the poker room 23*a*, 23*b* associated with the winning player by the amount of the pot (i.e., the total of all the player wagers) less the rake amount; and
4. in order to compensate an operator of the gaming server 22 who provides the facility to play the poker game and the poker rooms 23*a*, 23*b* that make their players available to the gaming server 22 to establish the game, the application server 32 credits, at step 58, a portion of the rake amount to the clearing account of each poker room in proportion to the number of players that participated in the turn of the game through that particular poker room.

Whereas the system 10 of FIG. 1 operates within the context of a single online poker room and establishes these games with players from that poker room only, the system 20 of FIG. 2 provides a facility for pooling players from different, possibly competing online poker rooms 23*a*, 23*b*. The system of FIG. 2 solves a technical problem of inter-entity transaction settlement by means of a clearing account facility and a separate clearing account corresponding to each entity from which participating players are drawn, enabling the establishment and administration of an online multiplayer zero-sum game from a pool of would-be players drawn from several different on-line entities.

Figure 5:
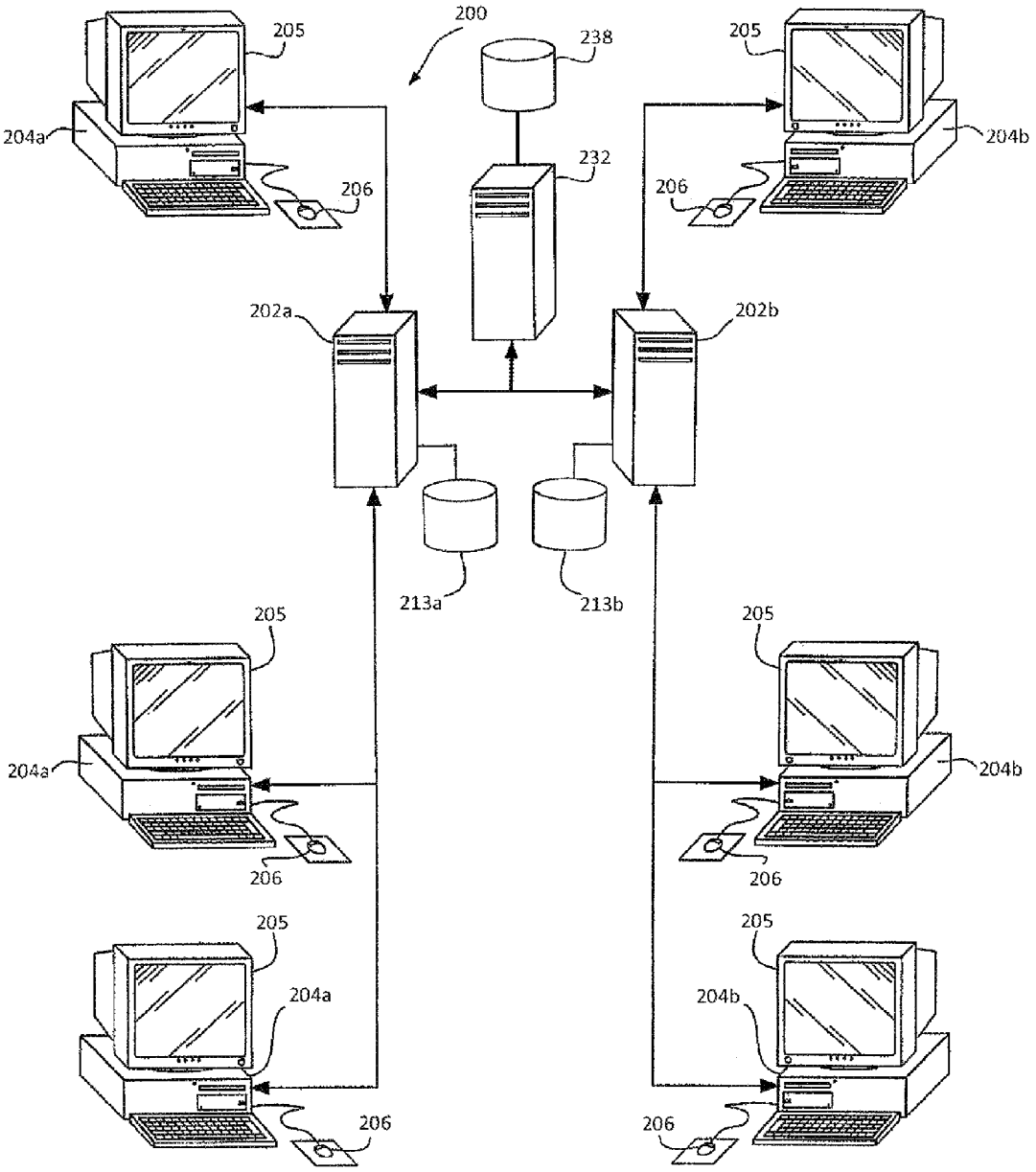
FIG. 5 is a schematic representation of a first embodiment of a system for playing virtual multiplayer zero-sum games.

FIG. 5 illustrates an embodiment of an improved system for playing virtual multiplayer poker games, which is indicated generally by reference numeral 200. The example system 200 includes two distinct networked gaming servers 202*a*, 202*b* accessible to would-be players (not shown) through user access facilities 204*a*, 204*b* in the form of networked computing devices such as computer workstations, each having a corresponding display 205 and an associated pointing device 206. The system 200 of FIG. 5 thus comprises two subsystems, each having a centralised topology of the type shown in FIG. 1.

The multiplayer poker games on each gaming server 202*a*, 202*b* are facilitated by means of a workstation-stored program (not shown) referred to, for convenience, as a client process that is executable on a computer workstation 204, and a server-stored program (not shown), or server process, that is executable on a gaming server. The server process (not shown) generates one or more random events that affect the outcome of a game of poker, such as the dealing of cards to participating players. The client process on a computer workstation 204 of a participating player obtains the result of the random events from a gaming server and displays the outcome of the game on the display monitor 205 of the computer workstation in an intelligible manner.

In this example embodiment, gaming servers 202*a* and 202*b* may belong to separate, possibly competing entities. It is therefore envisaged that the server-stored programs in gaming servers 202*a* and 202*b* may be different programs. As in the system of FIG. 1, the server-stored program (not shown) in each gaming server may spawn as many separate instances of multiplayer poker games as required in order to satisfy player demand. The various game instances hosted on a gaming server 202 are independent of each other and of the games hosted on the other gaming server. Each gaming server 202*a*, 202*b* includes a respective database 213*a*, 213*b* that stores game information data for active game instances hosted on that gaming server. Each database 213*a*, 213*b* is updated continuously to store real-time or near real-time information relating to the game instances hosted on the corresponding gaming server 202*a*, 202*b* such as the name of each instance (e.g., a table name), the identity of players at each table, the table stakes, etc. Each gaming server 202*a*, 202*b* provides its game information data to the computer workstations 204*a*, 204*b*, respectively, in the form of lobby pages.

In order to play multiplayer poker from any computer workstation 204, a client process may first be downloaded to that computer workstation, for example, from a gaming server 202 or from a separate download server (not shown). It is envisaged that the client process in computer workstations 204*a* that are logically connected to gaming server 202*a* may be different to the client process in computer workstations 204*b* that are logically connected to gaming server 202*b*. The client process in any computer workstation 204 presents the user with a GUI 100 similar to that of FIG. 3. Although the GUIs in computer workstations 204*a* and 204*b* may be different, they will both have activatable icons 104, 106, 108 and 114 that enable the player to make all necessary game play decisions, but will typically have different trademarks, colour schemes or "look and feel" depending from which poker room the client process was downloaded.

As outlined above, gaming server 202*a* serves the game information data in its database 213*a* to the computer workstations 204*a* that are connected to that gaming server. The client process in each computer workstation 204*a* displays this game information data on the computer workstation in the form of lobby pages that list all active game instances hosted on gaming server 202*a*, thereby allowing a player to select a game instance to join. In the same manner, the client process in the computer workstation 204*b* of each player that is connected to gaming server 202*b* displays a list of active game instances hosted on gaming server 202*b*. Under this arrangement, a player at a computer workstation 204*a* is only able to see and to join a game instance that is hosted on gaming server 202*a*, while a player at a workstation 202*b* is only able to see and to join a game instance that is hosted on gaming server 202*b*. As a consequence, players who are logged in at computer workstations 204*a* are segregated from those logged in at computer workstations 204*b* and cannot participate in the same instance of the poker game.

In order to overcome this disadvantage, gaming server 202*b* transmits the game information data in database 213*b* to gaming server 202*a* at regular intervals. Gaming server 202*a* consolidates this received game information data into its own database 213*a*. With such an adaptation, the lobby pages displayed by the client process in the computer workstations 204*a* list all game instances currently in progress that are hosted on either gaming server 202*a* or 202*b*. A player at a computer workstation 204*a* is then able to join a game instance hosted on gaming server 202*b*, if desired. The effect of this is that players logged in to gaming server 202*a* are "pooled" with those of gaming server 202*b* for participation in game instances hosted on gaming server 202*b*. The converse does not apply, however; players logged in to with gaming server 202*b* are not pooled with those of gaming server 202*a* for games hosted on gaming server 202*a*, as the games hosted on the latter gaming server are not visible to players at computer workstations 204*b*.

It will be appreciated, however, that game information in database 213*a* can be consolidated in a similar manner into game information database 213*b* of gaming server 202*b*. The contents of game information databases 213*a* and 213*b* will then be identical, permitting players at computer workstations 204*b* to also see and to participate in game instances hosted on gaming server 202*a* in addition to those hosted on gaming server 202*b*. In this variation of the embodiment, the players logged in to either gaming server 202*a*, 202*b* are fully pooled, without restriction.

Figure 6:
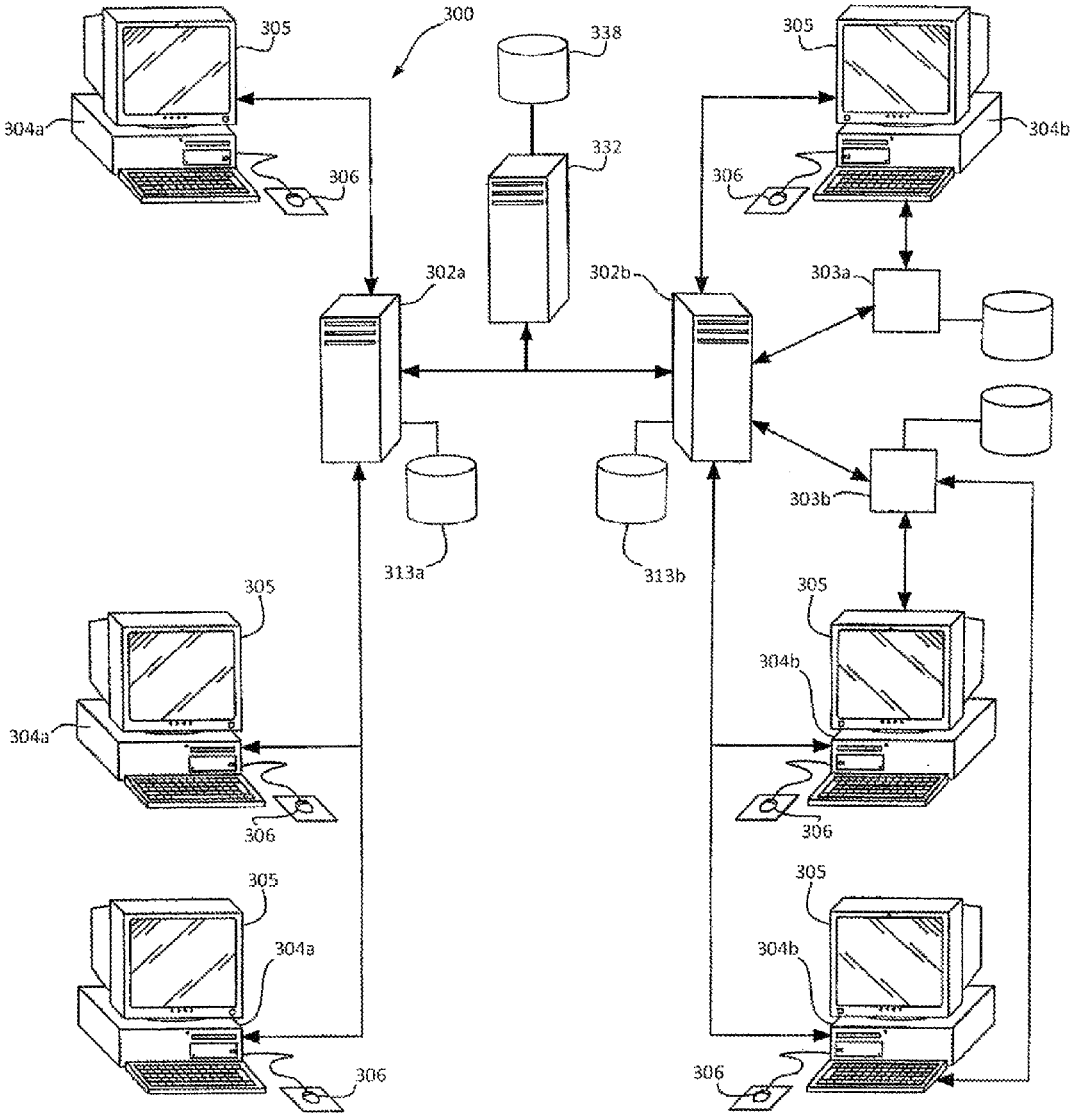
FIG. 6 is a schematic representation of a further embodiment of a system for playing virtual multiplayer zero-sum games.

Turning now to FIG. 6, a variation of the embodiment of FIG. 5 is illustrated. In this variation, a system 300 for playing virtual multiplayer poker games includes two distinct networked gaming servers 302*a*, 302*b* with corresponding user access facilities 304*a*, 304*b*, each having a display 305 and pointing device 306. The system 300 of FIG. 6 comprises two subsystems, one corresponding to gaming server 302*a* having a centralised topology of the type shown in FIG. 1, and the other corresponding to gaming server 302*b* having a distributed topology as described with reference to FIG. 2.

The gaming servers 302*a* and 302*b* may belong to separate, possibly competing, entities. It is envisaged that the server-stored programs in gaming servers 302*a* and 302*b* may be different programs. Furthermore, gaming server 302*b* is accessible to players from a number of different portals (i.e. poker room websites) 303*a*, 303*b*. For illustrative purposes, poker room website 303*a* is shown as being logically connected to one computer workstation 304*b*, while poker room website 303*b* is shown as being logically connected to two computer workstations 304*b*. Naturally, both poker room websites 303*a*, 303*b* can accommodate any desired number of computer workstations 304*b*, limited primarily by considerations of processing power, website hardware and network bandwidth. The gaming server 302*b* provides a facility for pooling players from the separate online poker rooms 303*a* and 303*b* which may themselves be competing entities. The gaming server 302*b* may, of course, permit pooling of players from a greater number of separate online poker rooms that just those of poker rooms 303*a* and 303*b*.

Each gaming server 302*a*, 302*b* includes a respective database 313*a*, 313*b* that stores game information data for game instances hosted on that gaming server. Each database 313*a*, 313*b* is updated continuously to store real-time or near real-time information relating to active game instances hosted on the corresponding gaming server 302*a*, 302*b* such as the name of each instance (e.g., a table name), the identity of players at each table, the table stakes, etc.

Gaming server 302*a* serves the game information data in its database 313*a* to the computer workstations 304*a* connected to that gaming server. The client process in each computer workstation 304*a* displays the game information data from gaming server 302*a* in the form of lobby pages that list all active game instances hosted on gaming server 302*a*, thereby allowing a player to select an active game instance to join. Similarly, the client process in each computer workstation 304*b* connected to gaming server 302*b* displays a list of active game instances hosted on that gaming server, utilising the game information data from database 313*b* served to the workstations by gaming server 302*b*.

Game information data in database 313*b* relating to game instances hosted on gaming server 302*b* is mirrored by the gaming servers 302*a*, 302*b* in game information database 313*a*, enabling the client process on computer workstations 304*a* to list all current game instances hosted on either gaming server 302*a* or 302*b*. Analogously, game information data in database 313*a* relating to game instances hosted on gaming server 302*a* may be mirrored in game information database 313*b*, thereby enabling the client process on computer workstations 304*b* to display all active game instances hosted on either gaming server. In effect, players logged in to either gaming server 302*a*, 302*b* are pooled, allowing any player to participate in any currently active game, irrespective of which gaming server the game is hosted on.

Figure 7:
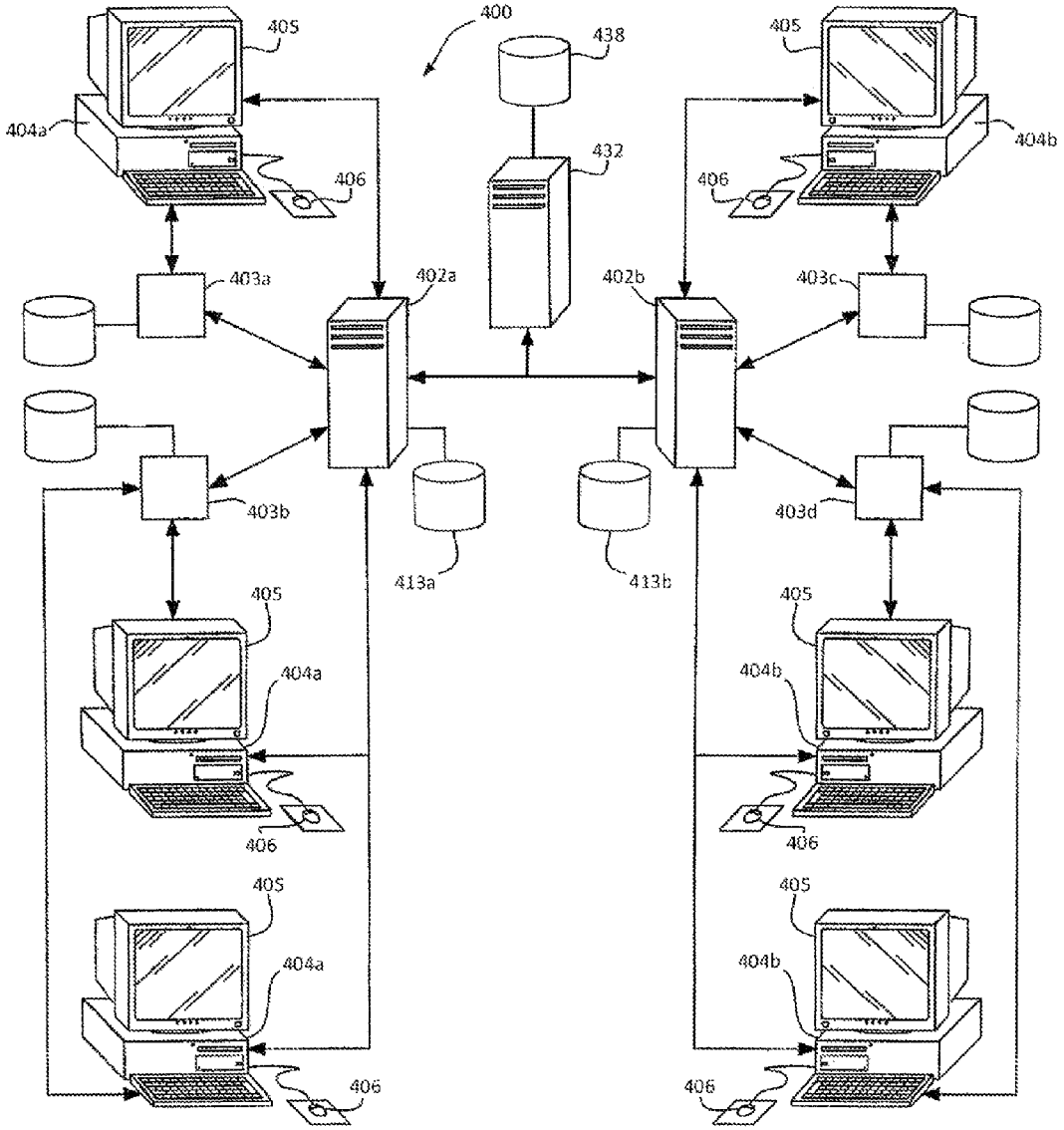
FIG. 7 is a schematic representation of a still further embodiment of a system for playing virtual multiplayer zero-sum games.

FIG. 7 illustrates a further variation. In this variation, a system 400 for playing virtual multiplayer poker games comprises two subsystems, each having a distributed topology as shown in FIG. 2. Each of these two subsystems has a respective networked gaming server 402*a*, 402*b* that may belong to separate entities, possibly competing entities. The server programs in the two gaming servers may differ. Gaming server 402*a* is accessible to players from portals (i.e. poker room websites) 403*a* and 403*b* by means of computer workstations 404*a* to which these workstations are logically connected, while gaming server 402*b* is accessible to players from different portals 403*c* and 403*d* by means of computer workstations 404*b*.

Each gaming server 402*a*, 402*b* includes a respective database 413*a*, 413*b* that stores game information data for game instances hosted on that gaming server. Each database 413*a*, 413*b* is updated continuously to store real-time or near real-time information relating to active game instances hosted on the corresponding gaming server 402*a*, 402*b* such as the name of each instance (e.g., a table name), the identity of players at each table, the table stakes, etc.

Game information data in database 413*b* relating to game instances hosted on gaming server 402*b* is mirrored by the gaming servers 402*a*, 402*b* in game information database 413*a*, enabling the client process on computer workstations 404*a* to list all current game instances hosted on either gaming server 402*a* or 402*b*. Analogously, game information data in database 413*a* relating to game instances hosted on gaming server 402*a* may be mirrored in game information database 413*b*, thereby enabling the client process on computer workstations 404*b* to display all active game instances hosted on either gaming server.

Thus, players at the workstations 404*a* can participate in active game instances on either gaming server, i.e. the players logged in to server 404*a* are made available to participate in game instances hosted on gaming server 402*b* together with players at computer workstations 404*b* who are logged in to gaming server 404*b*. Conversely, players at computer workstations 404*b* may be pooled with players at computer workstations 404*a* to participate in game instances hosted on gaming server 404*a*.

Although the system of FIG. 2 teaches aggregation of players from different portals, the system of FIG. 2 relies on single central gaming server 202 that hosts all of the accessible game instances. In contrast, however, the embodiment and variations thereof illustrated in FIGS. 5, 6 and 7 envisage two or more gaming servers, each hosting its own set of active game instances that are, nevertheless, made visible and available to players logged in to the other gaming server. Any player logged in to one of the gaming servers can see and access active game instances on the other gaming server.

Although the systems of FIGS. 5-7 have been described with reference to two separate gaming servers, this is for purposes of convenience only, and alternative embodiments can extend to include a greater number of networked gaming servers.

2. Game Play

As described above with reference to the embodiment of FIG. 5, the client process in computer workstation 204*a* displays to a player a list of active game instances hosted on either the player's local gaming server 202*a* or on the remote gaming server 202*b*. The client process on workstation 204*a* communicates natively with the server-stored program in the local gaming server 202*a*, and with the remote gaming server 202*b*, by means of a predetermined application programming interface (API) associated with the server-stored program in gaming server 204*b*. In order to communicate with the remote gaming server, the client process in computer workstation 204*a* constructs different messages that conform to the API. The manner in which the client process constructs the messages that conform to the API are known by those of ordinary skill in the art.

The set of messages that conform to the API can be sufficiently extensive to enable the player at computer workstation 204*b* to effect different game play decisions and other actions that may be required in order to play the selected game. For example, the message set may include the following distinct message types:

a) LOGIN—login to remote server;
b) VIEW TABLE—open up a particular game instance to view;
c) TAKE SEAT—join a particular game instance that has an unoccupied position;
d) ADD MONEY—take a defined sum of credit to a table;
e) WAGER RESPONSE—check, raise, fold, etc;
f) LEAVE SEAT—leave the current game instance;
g) REGISTER—register for a particular tournament;
h) DE-REGISTER—de-register from a particular tournament;
i) REBUY—purchase tournament chips when run out;
j) ADDON—purchase tournament chips without having run out; and
k) LOGOFF—logout from remote server.

It will be appreciated that the set of messages that conform to the API associated with the server-stored program in gaming server 202*b* may be different to that in the above example and may include additional messages, or may omit one or more messages described.

If the player at workstation 204*a* selects a game instance to join that is hosted on local gaming server 202*a*, the player is authenticated on the local gaming server 202*a* by means of a conventional login process. If, however, the player selects a game instance to join that is hosted on the remote gaming server 202*b*, the player is authenticated by means of a login process on the remote gaming server 202*b* which returns the player's login credentials to the player's local gaming server 202*a* for validation. Once authenticated, the player is admitted to the game instance and is able to commence play.

It is anticipated that the operation of the client process on computer workstation 204*a* will be transparent to the user, irrespective of whether it is communicating natively with local gaming server 202*a* when the player is participating in a game instance hosted on the local gaming server, or communicating according to the API with remote gaming server 202*b* when the player is participating in a game instance hosted on the remote gaming server.

If it is desired to also allow players at workstations 204*b* to participate in games hosted on gaming server 202*a* (i.e. now in the role of remote server) the client process in computer workstation 204*b* displays to a player a consolidated list of active game instances hosted on both gaming servers 202*a* and 202*b*. The client process on workstations 204*b* communicates natively with gaming server 202*b* (i.e. now acting as a local server) and with the remote gaming server 202*a* by means of an API associated with the server-stored program in gaming server 204*a*. If the server-stored programs in gaming servers 204*a* and 204*b* are different, the corresponding APIs of the two gaming servers will differ and the client processes of computer workstations 204*a* and 204*b* may utilise different sets of messages that conform to the different APIs, respectively.

Analogous descriptions apply in respect of the embodiments of FIGS. 6 and 7. In particular, with reference to FIG. 6, players at local gaming server 302*a*, i.e. players at computer workstations 304*a*, are pooled with players at gaming server 302*b* (the remote gaming server) for participation in game instances hosted on the remote gaming server. As in the embodiment of FIG. 5, this is achieved by adapting the client process of workstations 304*a* to communicate with the server-stored process of the remote gaming server by means of an applicable API. Players at computer workstations 304*b* may similarly be pooled with those at gaming server 302*a* for game instances hosted on that gaming server. The adaptation of client processes in workstations 404*a* and 404*b* of the embodiment of FIG. 7 to permit pooling of players during game play is identical and will not be described again here in detail.

3. Settlement of Player Wagers

The example embodiment of FIG. 5 includes an administration facility 232 in the form of an application server which is in communication with gaming servers 202*a*, 202*b*. The application server 232 provides a clearing account for each of the gaming servers 202*a*, 202*b*. Each gaming server includes a credit account for each player who participates in the game which logged in to that gaming server. In the system of FIG. 5, therefore, gaming servers 202*a* and 202*b* each have three associated player credit accounts.

During each turn of the game, the gaming server on which the game is hosted debits the credit account of each participating player by the amounts wagered by the player and, once the turn of the game is complete, credits the credit account to the winning player by the amount of the pot less an applicable rake amount. Such debits and credits are done directly for participating players logged in to the gaming server on which the game is hosted, and indirectly through the other gaming server for participating players logged into that other gaming server.

Furthermore:

1) the gaming server on which the game is hosted notifies the application server 232 of the outcome of the turn of the game and of the losses and winnings of the players that participated in the turn together with data representative of the gaming server 202*a*, 202*b* through which each player was logged in;
2) the application server 232 debits the clearing account of the gaming server 202*a*, 202*b* associated with each player that has wagered on the turn of the game by the total amount wagered by that player;
3) the application server 232 credits the clearing account of the gaming server 202*a*, 202*b* associated with the winning player by the amount of the pot (i.e. the total of all the player wagers) less the rake amount; and
4) in order to compensated the operators of the gaming server 202*a*, 202*b* who provide the facility to play the poker game and make their players available to establish the game, the application server 232 credits a portion of the rake amount to the clearing account of each gaming server in proportion to the number of players that participated in the turn of the game while logged in to that particular gaming server.

Turning now to the embodiment of FIG. 6 consisting of gaming server 302*a* having a centralised topology and gaming server 302*b* having a distributed topology, an administration facility 332 in the form of an application server is in communication with both of the gaming servers. The application server 332 provides a clearing account facility 338 having a clearing account for gaming server 302*a* and for each online poker room 303*a* and 303*b*. The gaming server 302*a* includes a credit account for each player that participates in the game while logged in to that gaming server. Additionally, each online poker room 303*a*, 303*b* includes a credit account for each player who participates in the game through that poker room website. In the system of FIG. 6, therefore, gaming server 303*a* has three associated player credit accounts, website 303*a* has one player credit account associated with it, while poker room website 303*b* has two associated player credit accounts.

During each turn of the game, the gaming server on which the game is hosted debits the credit account of each participating player by the amounts wagered by that player and, once the turn of the game is complete, credits the credit account of the winning player by the amount of the pot less an applicable rake amount. Such debits and credits are done directly in the case of participating players logged in to the gaming server on which the game is hosted, and indirectly through the non-hosting gaming server for the participating players logged in to the non-hosting gaming server.

Furthermore:

5) the gaming server on which the game is hosted notifies the application server 332 of the outcome of the turn of the game and of the losses and winnings of the players that participated in the turn together with data representative of the gaming server 302*a*, 302*b* and the poker room 303*a*, 303*b* (if applicable) through which each player accessed the game;
6) the application server 332 debits the clearing account of the gaming server 302*a* or poker room 303*a*, 303*b* associated with each player that wagered on the turn of the game by the total amount wagered by that player;
7) the application server 332 credits the clearing account of the gaming server 302*a*, poker room website 303*a* or poker room website 303*b* associated with the winning player by the amount of the pot (i.e. the total of the player wagers) less the rake amount; and
8) in order to compensate the operators of the gaming server 302*a* and poker rooms 303*a*, 303*b* who provide the facilities to play the poker game and make their players available to establish the game, the application server 332 credits a portion of the rake amount to the clearing accounts of the gaming server 302*a* and the poker rooms 303*a*, 303*b* in proportion to the number of players that participated in the turn of the game through that gaming server or through those poker rooms.

The embodiment of FIG. 7, which consists of two gaming servers 402*a*, 402*b* each having a distributed topology, includes an administration facility 432 in the form of an application server in communication with both of the gaming servers. The application server 432 provides a clearing account facility 438 having a clearing account for each online poker room 403*a-d*. Each online poker room includes a credit account for each player who participates in the game through that poker room website. In the system of FIG. 7, therefore, poker room website 403*a* and 403*c* each have one associated player credit account, while poker rooms 403*b* and 403*d* each have two associated player credit accounts.

During each turn of the game, the gaming server on which the game is hosted debits the credit account of each participating player by the amounts wagered by that player and, once the turn of the game is complete, credits the credit account of the winning player by the amount of the pot less an applicable rake amount. Such debits and credits are done directly in the case of the participating players logged in to the gaming server on which the game is hosted, and indirectly through the non-hosting gaming server for participating players logged in to the non-hosting gaming server.

Furthermore:

9) the gaming server on which the game is hosted notifies the application serve 432 of the outcome of the turn of the game and of the losses and winning s of the players that participated in the turn together with data representative of the poker room 403*a-d* through which each player accessed the game;

10) the application server 432 debits the clearing account of the poker room 403*a-d* associated with each player that wagered on the turn of the game by the total amount wagered by that player;

11) the application server 432 credits the clearing account of the poker room website 403*a-d* associated with the winning player by the amount of the pot (i.e. the total of the player wagers) less the rake amount; and 12) in order to compensate the operators of the poker rooms 403*a-d* who provide the facilities to play the poker game and make their players available to establish the game, the application server 432 credits a portion of the rake amount to the clearing accounts of the poker rooms 403*a-d* in proportion to the number of players that participated in the turn of the game through those poker rooms.

What is claimed is:

1. A system for playing a multiplayer zero-sum game, comprising:

a plurality of gaming servers, wherein each gaming server is able to host separate instances of the multiplayer zero-sum game that are independent of each other, and for each such instance of the multiplayer zero-sum game the host gaming server is configured to (i) generate random events that are displayable as outcomes on client computers used by players participating in the instance of the game, (ii) enable each participating player to place a wager for each turn of the game, and (iii) determine a winner for each turn of the game, and wherein the plurality of gaming servers comprises a first gaming server and a second gaming server; and a plurality of databases, wherein each database is configured to store game information data regarding active instances of the multiplayer zero-sum game hosted by a respective gaming server, and at least one of the databases is configured to store game information data regarding active instances of the multiplayer zero-sum game hosted by multiple gaming servers, wherein the plurality of databases comprise a first database configured to store at least game information data for active instances of the multiplayer zero-sum game that are hosted on the first gaming server and a second database configured to store game information data for active instances of the multiplayer zero-sum game that are hosted on the second gaming server, and wherein the first database differs from the second database, wherein each gaming server is configured to provide the game information data stored in its respective database to client computers of prospective players, wherein the client computers communicate with the plurality of gaming servers by messages that conform to an application programming interface (API), wherein the second gaming server is configured to transmit game information data regarding active instances of the multiplayer zero-sum game in the second database to the first gaming server at regular intervals, and wherein the first gaming server is configured to consolidate the game information data regarding active instances of the multiplayer zero-sum game received from the second gaming server into the first database.

2. The system of claim 1, wherein the game information data in each database comprises one or more of the following for each instance of the multiplayer zero-sum game: (i) a name of the instance, (ii) the identity of each player, (iii) table stakes, and (iv) available seats.

3. The system of claim 1, wherein each gaming server is configured to provide the game information data stored in its respective database in the form of lobby pages.

4. The system of claim 3, wherein the lobby pages provided by each gaming server comprise a list of active instances of the multiplayer zero-sum game hosted by that gaming server.

5. The system of claim 4, wherein the lobby pages provided by a gaming server are displayable on a client computer of a prospective player, thereby allowing the prospective player to join an instance of the multiplayer zero-sum game hosted by that gaming server.

6. The system of claim 4, wherein the lobby pages provided by at least one gaming server comprise a list of active instances of the multiplayer zero-sum game hosted by multiple gaming servers.

7. The system of claim 6, wherein the lobby pages provided by the at least one gaming server are displayable on a client computer of a prospective player, thereby allowing the prospective player to join an instance of the multiplayer zero-sum game hosted by any of the multiple gaming servers.

8. The system of claim 1, wherein the first gaming server is configured with a login process configured to authenticate a remote player prior to joining an instance of the multiplayer zero-sum game hosted by the first gaming server, wherein the remote player is hosted on a gaming server of the plurality of gaming servers other than the first server.

9. The system of claim 1, wherein the first gaming server is configured to provide the game information data stored in the first database in the form of lobby pages.

10. The system of claim 9, wherein the lobby pages provided by the first gaming server are displayable on a client computer of a prospective player to list active instances of the multiplayer zero-sum game that are hosted by the first gaming server and active instances of the multiplayer zero-sum game that are hosted by the second gaming server, thereby allowing the prospective player to join an instance of the multiplayer zero-sum game that is hosted by either of the first and second gaming servers.

11. The system of claim 1, wherein the first gaming server is configured to transmit game information data regarding active instances of the multiplayer zero-sum game in the first database to the second gaming server at regular intervals, and wherein the second gaming server is configured to consolidate the game information data regarding active instances of the multiplayer zero-sum game received from the first gaming server into the second database.

12. The system of claim 11, wherein the second gaming server is configured to provide the game information data stored in the second database in the form of lobby pages.

13. The system of claim 12, wherein the lobby pages provided by the second gaming server are displayable on a client computer of a prospective player to list active instances of the multiplayer zero-sum game that are hosted by the first gaming server and active instances of the multiplayer zero-sum game that are hosted by the second gaming server, thereby allowing the prospective player to join an instance of the multiplayer zero-sum game that is hosted by either of the first and second gaming servers.

14. The system of claim 1, wherein the first and second gaming servers are operated by separate, competing entities.

15. The system of claim 1, further comprising:

an application server in communication with the first and second gaming servers, wherein for each turn of a game hosted by one of the first and second gaming servers that pools together players associated with both the first and second gaming servers the application server is configured to update separate clearing accounts for the first and second gaming servers.

16. The system of claim 15, wherein the hosting gaming server is configured to notify the application server of the outcome of each turn of the game, including winnings and losses of participating players and data representative of the gaming server through which each player was logged in; and the application server is configured to responsively (i) debit the clearing account of the gaming server associated with each player who has wagered on the turn of the game by the total amount wagered by that player, (ii) credit the clearing account of the gaming server associated with each winning player by the amount of the pot less any rake amount, and (iii) credit a portion of any rake amount to the clearing accounts of the first and second gaming servers in proportion to the total number of players that participated in the turn of the game while logged in to that particular gaming server.

17. The system of claim 16, wherein each of the first and second gaming servers maintains a credit account for each participating player associated with that gaming server.

18. The system of claim 1, wherein at least the second gaming server is accessible through a plurality of portals.

19. The system of claim 18, wherein the portals are poker room websites.

20. The system of claim 18, wherein the portals are separately operated by competing entities.

21. The system of claim 18, wherein each portal can be logically connected to a plurality of client computers simultaneously.

22. The system of claim 18, further comprising:

an application server in communication with the first and second gaming servers, wherein for each turn of a game hosted by one of the first and second gaming servers that pools together players associated with the first gaming server and the plurality of portals the application server is configured to update separate clearing accounts for the first gaming server and for each of the portals.

23. The system of claim 22, wherein the hosting gaming server is configured to notify the application server of the outcome of each turn of the game, including winnings and losses of participating players and data representative of the gaming server and/or portal through which each player accessed the game; and the application server is configured to responsively (i) debit the clearing account of the gaming server or portal associated with each player who has wagered on the turn of the game by the total amount wagered by that player, (ii) credit the clearing account of the gaming server or portal associated with each winning player by the amount of the pot less any rake amount, and (iii) credit a portion of any rake amount to the clearing account of the first gaming server in proportion to the total number of players that participated in the turn of the game through the first gaming server and to the clearing account of each portal in proportion to the total number of players that participated in the turn of the game through that portal.

24. The system of claim 23, wherein the first gaming server includes a credit account for each player participating in the game through the first gaming server and each portal includes a credit account for each player participating in the game through that portal.

25. The system of claim 1, wherein the first gaming server is accessible through a first plurality of portals and the second gaming server is accessible through a second plurality of portals.

26. The system of claim 25, further comprising:

an application server in communication with the first and second gaming servers, wherein for each turn of a game hosted by one of the first and second gaming servers that pools together players associated with the first plurality of portals and the second plurality of portals the application server is configured to update separate clearing accounts for each of the portals.

27. The system of claim 26, wherein the hosting gaming server is configured to notify the application server of the outcome of each turn of the game, including winnings and losses of participating players and data representative of the portal through which each player accessed the game; and the application server is configured to responsively (i) debit the clearing account of the portal associated with each player who has wagered on the turn of the game by the total amount wagered by that player, (ii) credit the clearing account of the portal associated with each winning player by the amount of the pot less any rake amount, and (iii) credit a portion of any rake amount to the clearing account of each portal in proportion to the total number of players that participated in the turn of the game through that portal.

28. The system of claim 27, wherein each portal includes a credit account for each player participating in the game through that portal.

29. The system of claim 1, wherein the multiplayer zero-sum game is a multiplayer poker game.

30. A method comprising:

a client computer receiving from a local gaming server a list of active instances of a multiplayer zero-sum game, wherein the list includes active game instances hosted by the local gaming server and active game instances hosted by a remote gaming server, wherein the client computer communicate at least with the remote gaming server by messages that conform to an application programming interface (API), wherein the active game instances hosted by the local gaming server are independent of each other, wherein the active game instances hosted by the remote gaming server are independent of each other, wherein the active game instances hosted by the local gaming server differ from and are independent of the active game instances hosted by the remote gaming server, wherein the remote gaming server is configured to transmit game information data for the active game instances hosted by the remote gaming server to the local gaming server at regular intervals, and wherein the local gaming server is configured to consolidate the game information data for the active game instances received from the remote gaming server into a database configured to store game information data for the active game instances hosted by the local gaming server;

the client computer displaying the list to a player; and the client computer receiving from the player a selection of an active game instance on the list.

31. The method of claim 30, wherein the selected game instance is hosted by the local gaming server, further comprising:

when the player participates in the selected game instance hosted by the local gaming server, the client computer communicating natively with the local gaming server.

32. The method of claim 30, wherein the selected game instance is hosted by the remote gaming server, further comprising:

when the player participates in the selected game instance hosted by the remote gaming server, the client computer communicating with the remote gaming server by means of an application programming interface (API).

33. The method of claim 30, wherein the local and remote gaming servers are operated by separate, competing entities.

34. The method of claim 30, wherein the multiplayer zero-sum game is a multiplayer poker game.

35. A method for settlement of player wagers, comprising:

a host gaming server hosting a multiplayer zero-sum game involving a plurality of players associated with a plurality of gaming entities, the plurality of players including one or more players using client computers that communicate natively with the host gaming server and one or more players using client computers that communicate with the host gaming server by means of an application programming interface (API), wherein each player is associated with a respective gaming entity with which the player has a credit account, and wherein each gaming entity has a respective clearing account, the host gaming server comprising a database configured to store game information data for active instances of the multiplayer zero-sum game hosted on the host gaming server and for active instances of the multiplayer zero-sum game hosted on a remote gaming server, wherein the active game instances hosted by the local gaming server are independent of each other, wherein the active game instances hosted by the remote gaming server are independent of each other, wherein the active game instances hosted by the local gaming server are independent of the active game instances hosted by the remote gaming server, and wherein the game information data for the active instances of the multiplayer zero-sum game hosted on the host gaming server differs from the game information data for active instances of the multiplayer zero-sum game hosted on the remote gaming server, the host gaming server receiving, from the remote gaming server, the game information data for the active instances of the multiplayer zero-sum game hosted by the remote gaming server at regular intervals;

the host gaming server consolidating the game information data received from the remote gaming server into the database configured to store the game information data for the active game instances hosted by the host gaming server;

the host gaming server notifying an application server of an outcome of a turn of the game, including losses and winnings of the players participating in the turn, together with data representative of each gaming entity associated with each participating player;

the application server debiting the clearing account of each gaming entity associated with each player that has wagered on the turn of the game by the total amount wagered by that player;

the application server crediting the clearing account of each gaming entity associated with each winning player by the amount of the pot less a rake amount; and the application server crediting a portion of the rake amount to the clearing account of each gaming entity in proportion to the number of participating players associated with that gaming entity.

36. The method of claim 35, wherein the plurality of gaming entities includes at least one gaming server other than the host gaming server.

37. The method of claim 35, wherein the plurality of gaming entities includes a plurality of portals.

38. The method of claim 35, further comprising:

the host gaming server debiting the credit account of each player that has wagered on the turn of the game by the total amount wagered by that player; and the host gaming server crediting the credit account of each winning player by the amount of the pot less the rake amount.

39. The method of claim 35, wherein the multiplayer zero-sum game is a multiplayer poker game.

* * * * *